United States Patent [19]

Rolfe et al.

[11] 4,287,997

[45] Sep. 8, 1981

[54] CONTAINER FOR TRANSPORTED GOODS

[76] Inventors: Keith O. Rolfe, Netley, Goovigen, Queensland, Australia, 4702; Clifford E. Smith, "Karawatha", Thangool, Queensland, Australia, 4716

[21] Appl. No.: 116,546

[22] Filed: Jan. 29, 1980

[51] Int. Cl.[3] ..... B65D 21/02; B65D 88/12

[52] U.S. Cl. ..... 220/1.5; 206/504; 206/511; 220/234; 220/23.6

[58] Field of Search ..... 220/1.5, 23.4, 23.6; 206/504, 511, 821

[56] References Cited

U.S. PATENT DOCUMENTS

| | | | |
|---|---|---|---|
| 2,457,842 | 1/1949 | Smith et al. | 206/511 X |
| 2,483,464 | 10/1949 | Johnson | 206/504 X |
| 2,664,219 | 12/1953 | Schmidt | 220/1.5 |
| 2,702,142 | 2/1955 | Jones | 220/1.5 X |
| 3,073,466 | 1/1963 | Greer et al. | 220/23.4 X |
| 3,130,855 | 4/1964 | Gunn, Jr. | 220/1.5 X |
| 3,140,007 | 7/1964 | Nettleship | 206/511 X |
| 3,586,204 | 6/1971 | Roper | 206/512 X |
| 3,828,964 | 8/1974 | Bonnot | 206/511 X |

FOREIGN PATENT DOCUMENTS

| | | | |
|---|---|---|---|
| 2518396 | 11/1975 | Fed. Rep. of Germany | 220/23.4 |
| 290468 | 4/1953 | Switzerland | 206/511 |

*Primary Examiner*—Allan N. Shoap

*Attorney, Agent, or Firm*—Schwartz, Jeffery, Schwaab, Mack, Blumenthal & Koch

[57] ABSTRACT

A container for transported goods can be carried by a road transport vehicle arranged longitudinally or transversely, its length being approximately equal to its width. Supports fixed under the container define passages to receive, from either end and either side, the arms of a fork-lift vehicle, and further are made for inter-engagement with locating members on the container top so two superimposed similar containers are held in alignment. One end of the container, with a doorway and closure, also has means for releasably locking the container end to end with the corresponding end of another similar container.

2 Claims, 3 Drawing Figures

CONTAINER FOR TRANSPORTED GOODS

BACKGROUND OF THE INVENTION

This invention relates to an improved container for transported goods.

Although shipping containers are very widely used for the transport of goods by ship and rail, they are generally very large, normally eight feet high, eight feet wide and either twenty or forty feet in length, and so not well suited to transport by moderate-sized road transport. A further disadvantage in the large-sized shipping containers is that in many cases a shipper wishes to freight goods of a lesser volume than will fill a conventional container. In such a case, his goods must be added to those of other shippers of small volumes of goods. This frequently results in delays, and also increases the likelihood of pillaging after a locked container has been unlocked for the separation of the goods of different shippers for transport to their separate destinations.

The general object of the present invention is to provide a container for the shipping or other transport of goods which will overcome these disadvantages.

BRIEF SUMMARY OF THE INVENTION

A container according to the invention is substantially cubic in shape, its width and length being such that it may be carried on a small or medium size road transport vehicle without exceeding the permissible load width, whether the container is arranged laterally or longitudinally on the vehicle. In one end of the container there is a doorway through which goods may be loaded and unloaded, this opening being normally closed by a door; and this end of the container is provided with connector means whereby the container may be releasably locked end to end to the corresponding end of another similar container, the two doors thus being prevented from being opened. The container is mounted on supports with longitudinal and transverse passages between them, the supports holding the container raised above ground level so that the arms of a fork-lift vehicle can be engaged in the passages from either end or either side of the container. On top of the container, there are provided locating members adapted, when a similar container is superimposed in alignment, for interengagement with the supports of the upper container without obstructing the lateral and transverse passages. One of the locating members serves as a coaming for a hatch through which grain, for example, may be loaded into the container, and other locating members are made with means for connection to the hooks of a hoist.

BRIEF DESCRIPTION OF THE DRAWINGS

A preferred embodiment of the invention is shown in the accompanying drawings, wherein.

DETAILED DESCRIPTION OF THE PREFERRED EMBODIMENT

Figure 1:
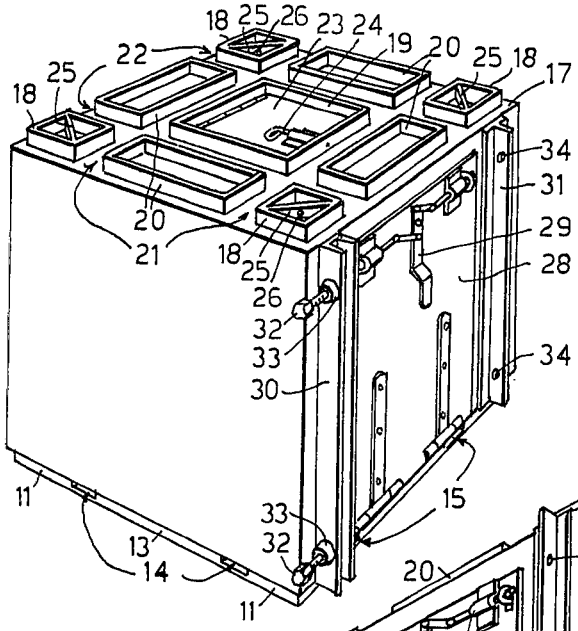
FIG. 1 is a perspective view of a goods container according to the invention, seen from above.
Figure 2:
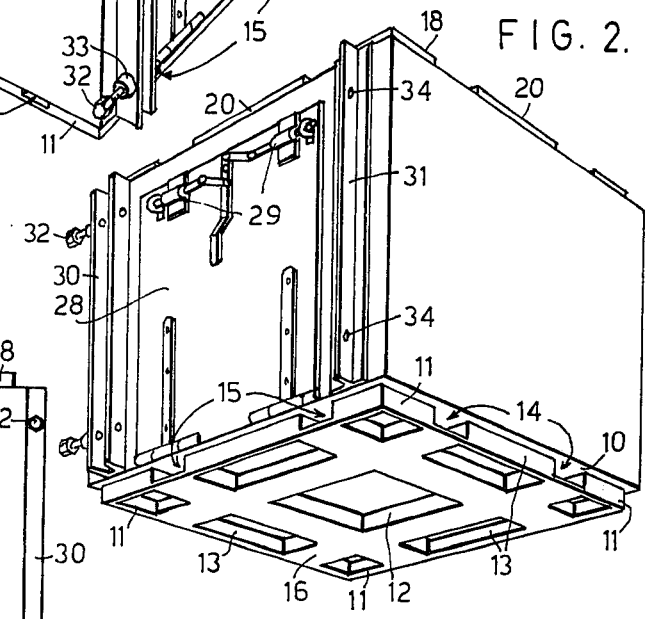
FIG. 2 is a perspective view of the container from below.

Each of the containers illustrated is more or less of cubic form, and of metal plate applied to a sturdy internal frame (not shown) of any suitable type. The bottom plate 10 of the container has welded to it a number of box-like supporting members comprising four similar corner members 11, square in plan view; a central member 12, of larger square shape in plan view, and four similar intermediate side or end members 13, these members being so arranged and spaced as to define two parallel transverse passages 14 intersected by two similarly spaced parallel longitudinal passages 15. A reinforcing plate 16 parallel to the bottom plate 10 and welded to peripheral parts of the bottom supporting members 11, 12 and 13, closes the bottoms of the transverse and longitudinal passages 14 and 15, which are spaced and dimensioned to receive the arms of the fork of a fork-lift truck or the like.

Figure 3:
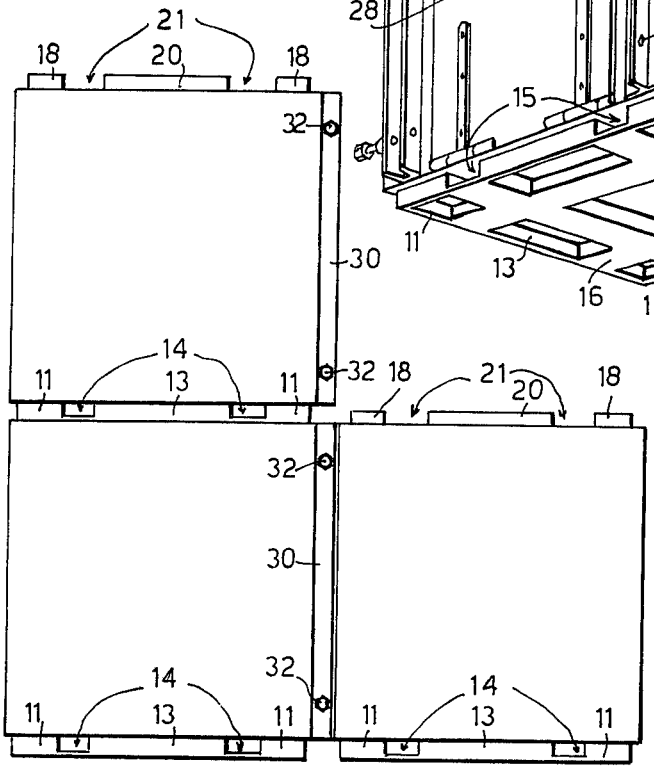
FIG. 3 is a side elevational view of an assembly of three of the containers shown in FIGS. 1 and 2.

The top plate 17 of the container also has welded to it a generally similar arrangement of box-like locating members, comprising four corner members 18, a central member 19 and four intermediate members 20 defining two transverse passages 21 and two longitudinal passages 22. The top box-like locating members 18, 19 and 20 are all somewhat smaller than the corresponding supporting members 11, 12 and 13 at the bottom of the container, so that, as shown in FIG. 3, one container can be placed upon another, the locating members of the lower container fitting closely in the corresponding supporting members of the upper container. The central locating member 19 forms a coaming about a hatch leading into the container and which is normally closed by a hinged lid 23 with any suitable locking means at 24. Each of the four corner locating members 18 has a diagonal plate 25 welded in it, and apertured centrally at 26 for engagement by a hook of a lifting device.

One end plate 27 of the container is formed with a large outlet opening closed by a door 28 hinged at or near to the bottom of the container and with any suitable locking means at 29. The door 28 is flanked by two upright members welded to the end plate 27, and consisting of a channel 30 at one side, and a flanged member 31 at the other side. Two similar containers, oppositely arranged, may be brought together, so the door 28 of the one is near to the door 28 of the other, the projecting vertical flange of the flanged member 31 of each container engaging closely in the vertical channel member 30 of the other. The two containers may then be releasably locked together by any suitable fastening means, for example captive bolts 32 threadedly engaged in bosses 33 on one flange of each channel member 30 and capable of being screwed in to pass through registering apertures 34 in the interposed flange of the flanged member 31. Any other suitable fastening means whereby the two containers may be releasably secured end to end may, of course, be used.

Two of the containers secured end to end may be shipped and railed similarly to a conventional shipping container and, when carried by rail or large road transport to its destination, the two containers may be separated, and each may be lifted by a conventional fork-lift or similar transporter and loaded onto a relatively small vehicle, the dimensions of the container being such that its width, whichever way it is loaded onto this vehicle, will be within the permissible limits for road transportation. For convenience in storage, one container may be placed, by a fork-lift, on top of another, as shown in FIG. 3, the interfitting supporting and locating members of the two containers ensuring that two or more superimposed containers will be aligned one with the other and will be stable. The door 28 of each container may be hingedly opened downward, facilitating the unloading of grain, for example, the loading of which may be easily done through the hatch at the top of the container. If preferred, a vertically slidable door may be used, or a side or top hinged door, and the top inlet opening may be omitted. The interconnection of the two containers with the doors 28 towards each other will add to the security of the contents.

We claim:

1. A container for transported goods of substantially rectangular form, having sides, ends, top and bottom, wherein:

the length of the container is substantially equal to its width, connector means are provided at one end of the container for releasably connecting the container, end to end, to the corresponding end of another similar container, a doorway and closure for said container in said one end thereof, supporting members of open-bottom box-like form secured below the container bottom for supporting it above ground level, passages between said supporting members capable of receiving, from both sides and both ends of the container, the tines of a fork-lift vehicle, and container locating members secured on the top of the container and arranged to interfit, without obstructing said passages, with said supporting members of a similar container superimposed thereon and in vertical alignment therewith, said locating members also being of open-top box-like form, with one of said locating members being a coaming for a hatch leading into the container, and a closure for said coaming.

2. A container according to claim 1 further including eyes provided in a plurality of said locating members for engagement by lifting hooks.

* * * * *